US008304016B2

(12) United States Patent
Chen et al.

(10) Patent No.: US 8,304,016 B2
(45) Date of Patent: Nov. 6, 2012

(54) METHOD OF MAKING FUSER MEMBER

(75) Inventors: Jiann-Hsing Chen, Fairport, NY (US); Jerry A. Pickering, Hilton, NY (US); Po-Jen Shih, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 63 days.

(21) Appl. No.: 12/647,569

(22) Filed: Dec. 28, 2009

(65) Prior Publication Data

US 2011/0159176 A1 Jun. 30, 2011

(51) Int. Cl.

| | |
|---|---|
| ***B41L 7/00*** | (2006.01) |
| ***B41L 9/00*** | (2006.01) |
| ***B41L 23/00*** | (2006.01) |
| ***B41L 25/00*** | (2006.01) |

(52) U.S. Cl. ..... 427/144

(58) Field of Classification Search ..... 427/144
See application file for complete search history.

(56) References Cited

U.S. PATENT DOCUMENTS

| | | | | |
|---|---|---|---|---|
| 3,435,500 | A | 4/1969 | Aser et al. | |
| 4,115,481 | A | 9/1978 | Finlay et al. | |
| 4,272,179 | A * | 6/1981 | Seanor | 430/124.33 |
| 4,303,761 | A | 12/1981 | Apotheker | |
| 4,482,476 | A | 11/1984 | Yoshimura et al. | |
| 4,789,565 | A | 12/1988 | Kon et al. | |
| 4,935,467 | A | 6/1990 | Cheng et al. | |
| 5,011,401 | A | 4/1991 | Sakurai et al. | |
| 5,153,660 | A | 10/1992 | Goto | |
| 5,547,759 | A | 8/1996 | Chen et al. | |
| 5,709,949 | A | 1/1998 | Chen et al. | |
| 5,736,250 | A * | 4/1998 | Heeks et al. | 428/447 |
| 5,998,034 | A | 12/1999 | Marvil et al. | |
| 6,586,100 | B1 | 7/2003 | Pickering et al. | |
| 6,596,357 | B1 | 7/2003 | Marvil et al. | |
| 7,195,853 | B1 | 3/2007 | Pickering et al. | |
| 7,494,706 | B2 | 2/2009 | Chen et al. | |
| 7,531,237 | B2 | 5/2009 | Chen et al. | |
| 7,534,492 | B2 | 5/2009 | Chen et al. | |
| 7,565,091 | B2 | 7/2009 | Jao et al. | |
| 2007/0296122 | A1 * | 12/2007 | Chen et al. | 264/346 |
| 2008/0280035 | A1 | 11/2008 | Jao et al. | |
| 2009/0250830 | A1 | 10/2009 | Jao et al. | |
| 2011/0159222 | A1 | 6/2011 | Chen et al. | |
| 2011/0159276 | A1 | 6/2011 | Chen et al. | |

FOREIGN PATENT DOCUMENTS

| | | | |
|---|---|---|---|
| EP | 1 376 260 | | 1/2004 |
| EP | 1376260 | A2 * | 1/2004 |
| EP | 1 168 103 | | 8/2005 |
| WO | 2007/149236 | | 12/2007 |

* cited by examiner

*Primary Examiner* — Michael Cleveland
*Assistant Examiner* — James M Mellott
(74) *Attorney, Agent, or Firm* — Andrew J. Anderson

(57) ABSTRACT

A method of making a fuser member having an annealed outer surface comprising: providing an outer layer comprising compatible first and second fluorothermoplastics over an outer substrate surface, wherein the first fluorothermoplastic is a crosslinkable polymer and the second fluorothermoplastic is a linear polymer; curing the outer layer to crosslink the first fluorothermoplastic whereby the resulting crosslinked first fluorothermoplastic and the linear polymer second fluorothermoplastic form a semi-interpenetrating polymer network (SIPN); and annealing an outer surface of the outer layer by contacting the fuser member with applied pressure against a heated surface, without first sintering the second fluorothermoplastic linear polymer through application of heat alone.

16 Claims, 2 Drawing Sheets

METHOD OF MAKING FUSER MEMBER

CROSS-REFERENCE TO RELATED APPLICATIONS

This application relates to commonly assigned, copending application Ser. No. 12/647,575, titled, "FLUOROCARBON THERMOPLASTIC MATERIALS CURED WITH ORGANIC PRIMARY AMINES" and application Ser. No. 12/647,573, titled, "FUSER MEMBER WITH FLUOROPOLYMER OUTER LAYER" having been filed on the same date herewith.

FIELD OF THE INVENTION

This invention relates to electrostatographic apparatus and coated fuser members and methods of making coated fuser members, and in particular to a fuser member which includes an outermost fluoropolymer resin layer disposed over an outer substrate surface comprising a semi-interpenetrating polymer network of compatible first and second fluorothermoplastics. More particularly, this invention relates to an improved coating for fuser members and the method of making coated fuser members for oil-free digital printing applications.

BACKGROUND OF THE INVENTION

Known to the electrostatographic fixing art are various fuser members adapted to apply heat and pressure to a heat-softenable electrostatographic toner on a receiver, such as paper, to permanently fuse the toner to the receiver. Examples of fuser members include fuser rollers, pressure rollers, fuser plates and fuser belts for use in fuser systems such as fuser roller systems, fuser plate systems and fuser belt systems. The term "fuser member" is used herein to identify one of the elements of a fusing system. Commonly, the fuser member is a fuser roller or pressure roller and the discussion herein may refer to a fuser roller or pressure roller, however, the invention is not limited to any particular configuration of fuser member.

One of the long-standing problems with electrostatographic fixing systems is the adhesion of the heat-softened toner particles to the surface of a fuser member and not to the receiver, known as offset, which occurs when the toner-bearing receiver is passed through a fuser system. There have been several approaches to decrease the amount of toner offset onto fuser members. One approach has been to make the toner-contacting surface of a fuser member, for example, a fuser roller and/or pressure roller of a non-adhesive (non-stick) material.

One known non-adhesive coating for fuser members comprises fluoropolymer resins, but fluoropolymer resins are non-compliant. It is desirable to have compliant fuser members to increase the contact area between a fuser member and the toner-bearing receiver. However, fuser members with a single compliant rubber layer absorb release oils and degrade in a short time leading to wrinkling artifacts, non-uniform nip width and toner offset. To make fluoropolymer resin coated fuser members with a compliant layer, U.S. Pat. Nos. 3,435,500 and 4,789,565 disclose a fluoropolymer resin layer sintered to a silicone rubber layer, which is adhered to a metal core. In U.S. Pat. No. 4,789,565, an aqueous solution of fluoropolymer resin powder is sintered to the silicone rubber layer. In U.S. Pat. No. 3,435,500, a fluoropolymer resin sleeve is sintered to the silicone rubber layer. Sintering of the fluoropolymer resin layer is usually accomplished by heating the coated fuser members to temperatures of approximately 500°

C. Such high temperatures can have a detrimental effect on the silicone rubber layer causing the silicone rubber to smoke or depolymerize, which decreases the durability of the silicone rubbers and the adhesion strength between the silicone rubber layer and the fluoropolymer resin layer. Attempts to avoid the detrimental effect the high sintering temperatures have on the silicone rubber layer have been made by using dielectric heating of the fluoropolymer resin layer, for example see U.S. Pat. Nos. 5,011,401 and 5,153,660. Dielectric heating is, however, complicated and expensive and the fluoropolymer resin layer may still delaminate from the silicone rubber layer when the fuser members are used in high-pressure fuser systems. U.S. Pat. Nos. 5,547,759 and 5,709,949 to Chen, et al. disclose a method of bonding a fluoropolymer resin to various substrate including silicone via a layer of fluoroelastomer layer and fluoropolymer containing polyamide-imide layer. But this requires a thin base layer to prevent the degradation of silicone base cushion substrate during the sintering process. U.S. Pat. Nos. 5,998,034 and 6,596,357 to Marvil et al. also discloses a multilayer fuser roller having fluopolymer coating on a compliant base layer. However, this requires pre-baking steps in an infrared oven to prevent the degradation of primer layer and silicone base cushion. In addition, a fuser member made with a fluoropolymer resin sleeve layer possesses poor abrasion resistance and poor heat resistance.

U.S. Pat. No. 7,195,853 describes a process for fusing toner employing a fuser roller having a surface layer that includes both a fluoroelastomer continuous phase, and also a discontinuous phase dispersed through the continuous phase in the form of domains. A problem with such fuser members, however, is that both the fluoroelastomer continuous phase and the discontinuous phase dispersed through the continuous phase are in the form of domains consisting of silicones, fluorosilicones, fluoroelastomer and perfluoropolyethers, which are high surface energy materials which can not release toner under oil-less fusing conditions.

U.S. Pat. Nos. 7,494,706; 7,531,237; 7,534,492; and U.S. Publication No. 2007/0296122 describe fuser members and methods of making such fuser members wherein the outer layer of the fuser member comprises an annealable fluoropolymer resin. While fluoropolymer resins typically provide an excellent non-stick material, it provides little compliance and conformability. While use of a cushion layer between the fuser member substrate and the outer layer improves performance, the non-compliant outer layer itself still encounters problems when fusing toner to various types of printed substrates. Fuser roller coating materials comprising polyperfluoroalkoxy-tetrafluoroethylene (PFA) dispersion coating as a roller top coat typically have three major issues: 1) high print gloss especially for uncoated heavy weight paper; 2) the fuser surface has surface cracking, in-track/x-track cutting under high stress and high loaded condition; and 3) insufficient contact of the PFA fuser surface to the rough toner image area for texture paper due to the non-compliant PFA surface. Additionally, outer layers comprising fluoropolymer resins typically require relatively high temperatures during manufacture thereof in order to sinter particulates of such fluoropolymer resin to form an integral layer coating, which high temperatures may be detrimental to underlying cushion and adhesive layers comprising relatively temperature sensitive materials.

For the foregoing reasons, there is a need for fuser members and a method of fabricating fuser members which have a fluoropolymer resin layer, and optionally a thick compliant layer or layers, to solve all the three major problems of the conventional PFA coatings without compromising the unique characteristics of PFA coating such as low surface energy, low C.O.F., tough mechanical property, high temperature resistance and annealing surface, and which does not subject the fuser member to high temperatures typically required for sintering of fluoropolymer resin particulates.

SUMMARY OF THE INVENTION

In accordance with one embodiment, the invention is directed towards a method of making a fuser member having an annealed outer surface comprising: providing an outer layer comprising compatible first and second fluorothermoplastics over an outer substrate surface, wherein the first fluorothermoplastic is a crosslinkable polymer and the second fluorothermoplastic is a linear polymer; curing the outer layer to crosslink the first fluorothermoplastic whereby the resulting crosslinked first fluorothermoplastic and the linear polymer second fluorothermoplastic form a semi-interpenetrating polymer network (SIPN); and annealing an outer surface of the outer layer by contacting the fuser member with applied pressure against a heated surface, without first sintering the second fluorothermoplastic linear polymer through application of heat alone. The SIPN advantageously provides a relatively compliant layer in comparison to use of the crosslinked polymer alone, and avoids the need for sintering of a layer formed from the linear polymer alone, thus avoiding subjecting the fuser member to high temperatures typically required for sintering of fluoropolymer resin particulates. Accordingly, the current invention provides a fuser member where the top layer provides advantageous release properties as well as the compliant and conformable properties, especially when employed over a base cushion layer such as a silicone rubber base layer.

The preferred fuser member obtained in the method of the invention, but not limited to this, includes a core member that includes a rigid outer surface. An adhesion promoter layer comprising silane or epoxy silane coupling agent is disposed on cylindrical outer surface of the core member. A resilient layer comprising an elastomer is disposed on the adhesion promoter layer. A tie layer is disposed on the resilient layer, the tie layer being made of fluoropolymers, fluoroelastomers, fluorocarbon thermoplastic copolymers and mixtures thereof. A primer layer, disposed on the tie layer, comprising perfluoroalkoxy resin and trifluoroethylene-perfluoroethylvinyl ether-perfluoroethylene vinyl phosphate or a mixture of perfluoroalkoxy resin and trifluoroethylene-perfluoroethylvinyl ether; and an outer layer of fluoropolymer resin made from an aqueous coated composition of polyperfluoroalkoxy-tetrafluoroethylene (PFA) and THV Fluoroplastics (FLC) polymers along with a soluble organic primary amine for crosslinking the THV Fluoroplastics (FLC) to form a SIPN. The outer surface of the outer layer of the fuser member is annealed, e.g., by contacting the outer layer at a temperature of from 80° C. below the melting point to 20° C. above the melting point of the second fluorothermoplastic and a pressure of greater than 5 psi.

ADVANTAGES

The fuser members obtained in accordance with the method of this invention provide a compliant PFA type fuser surface to solve all the three major problems of the conventional PFA coating such as 1) high print gloss especially for uncoated heavy weight paper, 2) the fuser surface has surface cracking, in-track/x-track cutting under high stress and high loaded condition, and 3) insufficient contact of the PFA fuser surface to the rough toner image area for texture paper due to the non-compliant PFA surface, without compromising the unique characteristics of PFA coating such as low surface energy, low C.O.F., tough mechanical property, high temperature resistance and annealing surface, while avoiding the need for subjecting the fuser member to high temperatures (typically at least 50 C above the melting point of the PFA polymer) required for sintering of fluoropolymer resin particulates.

These and other features, aspects, and advantages of the present invention will become better understood with regard to the following description and claims.

Figure 1:
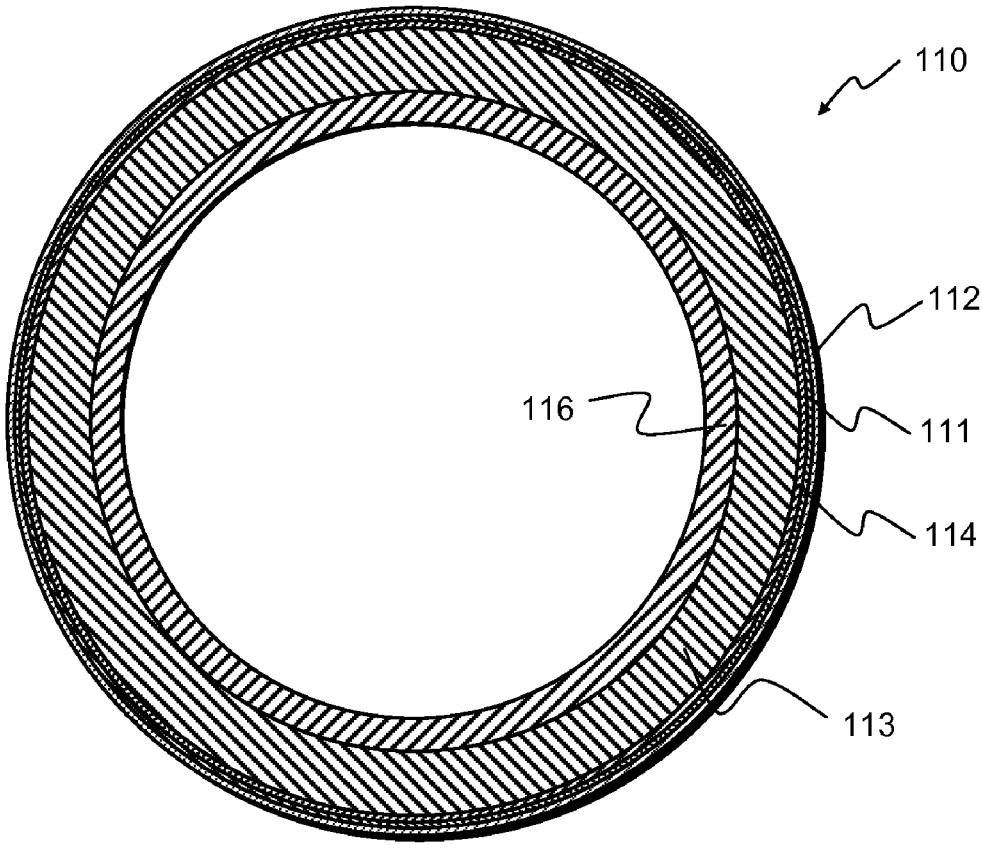
FIG. 1 is a cross-sectional view of a fuser member obtainable in accordance with an embodiment of the present invention.

For a better understanding of the present invention together with other advantages and capabilities thereof, reference is made to the following description and appended claims in connection with the preceding drawings.

DETAILED DESCRIPTION OF THE INVENTION

Sintering of non-stick perfluoroalkoxy-tetrafluoroethylene (PFA) type fluoropolymer resin top coat layers is usually accomplished by heating the coated fuser member to a temperature significantly higher than the resin melting point temperature, typically at least 50° C. above such melting point temperature. Attempts to avoid the detrimental effect the high sintering temperature may have upon underlying soft, heat unstable silicone rubber base layers have not been satisfactory and are complicated. The invention provides a method of making a fuser member having an annealed outer surface which advantageously avoids the need for such high sintering temperatures comprising: providing an outer layer comprising compatible first and second fluorothermoplastics over an outer substrate surface, wherein the first fluorothermoplastic is a crosslinkable polymer and the second fluorothermoplastic is a linear polymer; curing the outer layer to crosslink the first fluorothermoplastic whereby the resulting crosslinked first fluorothermoplastic and the linear polymer second fluorothermoplastic form a semi-interpenetrating polymer network (SIPN); and annealing an outer surface of the outer layer at more moderate temperatures than that typically applied for sintering by contacting the fuser member with applied pressure against a heated surface, without first sintering the second fluorothermoplastic linear polymer through application of heat alone. The SIPN provides a relatively compliant layer in comparison to use of the crosslinked fluorothermoplastic polymer alone, and avoids the need for sintering of a layer formed from the linear polymer alone, thus avoiding subjecting the fuser member to high temperatures typically required for sintering of fluoropolymer resin particulates. Accordingly, the current invention provides a fuser member where the top layer provides advantageous release properties as well as the compliant and conformable properties, especially when employed over a base cushion layer such as a silicone rubber base layer.

The outer layer provided over the outer substrate surface comprising compatible first and second fluorothermoplastics preferably comprises as the first fluorothermoplastic a crosslinked fluorocarbon thermoplastic random copolymer (THV) having the subunits of:

$-(CH_2CF_2)x-$, $-(CF_2CF(CF_3))y-$, and $-(CF_2CF_2)z-$, wherein x is from 1 to 40 or 60 to 80 mole percent, z is greater than 40 to no more than 89 mole percent, and y is such that x+y+z equals 100 mole percent, while the second fluorothermoplastic may comprise a liner polymer such as polytetrafluoroethylene, polyperfluoroalkoxy-tetrafluoroethylene, polyfluorinated ethylene-propylene or blends thereof. Preferably, the second fluorothermoplastic comprises polyperfluoroalkoxy-tetrafluoroethylene (PFA).

In the above formulas, x, y, and z are mole percentages of the individual subunits relative to a total of the three subunits (x+y+z), referred to herein as "subunit mole percentages." The curing agent use to crosslink the random copolymer can be considered to provide an additional "cure-site subunit," however, the contribution of these cure-site subunits is not considered in subunit mole percentages. In the fluorocarbon thermoplastic copolymer, x has a subunit mole percentage of from 1 to 40 or 60 to 80 mole percent, y has a subunit mole percentage of from 10 to 90 mole percent, and z has a subunit mole percentage of from 10 to 90 mole percent. In a currently preferred embodiment of the invention, subunit mole percentages are: x is from 30 to 40 or 70 to 80, y is from 10 to 60, and z is from 5 to 30; or more preferably x is from 35 to 40, y is from 40 to 58, and z is 5 to 10. In the currently preferred embodiments of the invention, x, y, and z are selected such that fluorine atoms represent at least 75 percent of the total formula weight of the $VF_2$, HFP, and TFE subunits.

Suitable curable fluorocarbon thermoplastic random copolymers are available commercially. In a particular embodiment of the invention, a vinylidene fluoride-co-tetrafluoroethylene co-hexafluoropropylene, which can be represented as -(VF)(75)-(TFE)(10)-(HFP)(25)-, may be employed. This material is marketed by Hoechst Company under the designation "THV Fluoroplastics" and is referred to herein as "THV." In another embodiment of the invention, a vinylidene fluoride-co-tetrafluoroethylene-co-hexafluoropropylene, which can be represented as -(VF)(42)-(TFE)(10)-(HFP)(58)-, may be used. This material is marketed by Minnesota Mining and Manufacturing, St. Paul, Minn., under the designation "3M THV" and is referred to herein as "THV-200." Other suitable uncured vinylidene fluoride-cohexafluoropropylenes and vinylidene fluoride-co-tetrafluoroethylene-cohexafluoropropylenes are available, for example, THV-400, THV-500, and THV-300. In general, THV Fluoroplastics are set apart from other melt-processable fluoroplastics by a combination of high flexibility and low process temperature. With flexural modulus values between 83 Mpa and 207 Mpa, THV Fluoroplastics are the most flexible of the fluoroplastics.

The molecular weight of the uncured first fluorothermoplastic polymer is largely a matter of convenience; however, an excessively large or excessively small molecular weight would create problems, the nature of which are well known to those skilled in the art. In a preferred embodiment of the invention the uncured first fluorothermoplastic polymer has a number average molecular weight in the range of about 100,000 to 200,000.

The second fluorothermoplastic polymer preferably comprises a semicrystalline fluoropolymer or a semicrystalline fluoropolymer composite. Such materials include polytetrafluoroethylene (PTFE), polyperfluoroalkoxy-tetrafluoroethylene (PFA), polyfluorinated ethylene-propylene (FEP), poly(ethylenetetrafluoroethylene), polyvinylfluoride, polyvinylidene fluoride, poly(ethylene-chloro-trifluoroethylene), polychlorotrifluoroethylene and mixtures thereof. Some of these fluoropolymer resins are commercially available from DuPont as Teflon™ or Silverstone™ materials.

The preferred second fluorothermoplastics employed in the SIPN of the outer layer is a polyperfluoroalkoxy-tetrafluoroethylene (PFA), commercially available from DuPont under the trade name Teflon™ 855P322-32, Teflon™ 855P322-53, Teflon™ 855P322-55, Teflon™ 855P322-57, Teflon™ 855P322-58 and Teflon™ 857-210. Particularly Teflon™ 855P322-53; Teflon™ 855P322-57, and Teflon™ 855P322-58 because they are durable, abrasion resistant and form a very smooth layer.

The curing agent used to cross-link the fluorocarbon random copolymer may advantageously comprise an aqueous soluble organic primary amine compound. Such compounds may be organic mono or preferably polyfunctional (i.e., di- or higher-) amine compounds having a molecular weight of less than 300 dalton, more typically less than 200 dalton, and preferably are organic di-, tri- or higher amine compounds and most preferably organic tetraamine compounds. Examples of such aqueous soluble organic primary amine compounds include primary amines having from one to six carbon atoms ($C_1$ to $C_6$), such as methylamine, ethylenediamine, trimethylenediamine, tetramethylenediamine, hexamethylenediamine, triethylenetetramine (TETA), etc. The ratio of organic primary amine to the fluorocarbon thermoplastic random copolymer may preferably be between about 1 and to 10 by parts of per hundred parts of fluorocarbon thermoplastic random copolymer, more preferably between about 2 and 5 parts of per hundred parts of fluorocarbon thermoplastic random copolymer.

Curing of such first fluorothermoplastic fluorocarbon random copolymer in the presence of the compatible second fluorothermoplastic linear polymer results in a semi-interpenetrating polymer network. Employing water soluble organic primary amines facilitates curing by dehydrogenation of the fluorocarbon thermoplastic random copolymer and then by addition reaction of amine function group with the double bond created by dehydrogenation. To form the outer layer, the uncured fluorocarbon thermoplastic random copolymer and second linear polymer may be mixed with an aqueous soluble organic primary amine curing agent, coated over the base cushion, and cured. Such process advantageously enables curing in aqueous systems at relatively lower cure temperatures and short cure times (e.g., 2 to 10 hours, preferably 2 to 4 hours, at a temperature of less than 200° C., preferably 150° C. to 199° C.).

The annealing step of the present invention applies pressure and heat to the outer layer by an annealing device or object, preferably stiff and of low surface energy, i.e., non-sticky, and heat sources to raise the contacting surface temperature to a desired level when this annealing object comes in contact with the thermoplastic coating with a prescribed pressure. While the temperature for annealing of PFA type resin layers can start from 150° C. below the melting point of the thermoplastic material and can range up to 100° C. above the melting point of the material, it is preferred to employ an annealing temperature in the range of from about 80° C. below the melting point up to 20° C. above the melting point of the compatible second fluorothermoplastic linear polymer employed in the semi-interpenetrating polymer network outer layer prepared in accordance with the present invention in order to avoid the need for excessive pressure and/or temperatures which might damage the first crosslinked thermoplastic material and/or underlying layers. For the example of PFA, which has a melting point around 305° C., it means that the temperature for annealing preferably is within the range is from about 225° C. to 325° C.

An example design of the annealing device is annealing roller(s) made of steel with chromed surface, either smooth or of certain surface roughness level, and with internal heating lamps which are program-controlled based on the feedback information of the temperature sensors mounted on the surface of the annealing roller. As the annealing device is in action, the annealing roller(s), for example, will be pressurized against the coating of the product, e.g. the fuser roller. An advantage of using a "roller" is that advancing the annealing from one surface area to another can be conveniently and smoothly achieved by rotating the annealing roller(s) on the surface of the product and gradually with time by a specified sequence anneal the thermoplastic coating on the product completely or to a level function of its position. An example of the annealing procedure, for the example fuser roller product is to heat up the annealing roller to the melting temperature of the compatible second fluorothermoplastic linear polymer employed in the coating material forming the semi-interpenetrating polymer network outer layer prepared in accordance with the present invention, for the example of PFA, 305° C., next engage the annealing roller against the fuser roller surface which rotates at a speed of 3 rpm, (with possible range from 1 to 10 rpm), then gradually increase the contact pressure to 50 psi, with possible range from 5 to 200 psi, such as in 30 seconds more or less.

As the full engagement starts, allow the fuser roller to roll through the nip between itself and the annealing roller for multiple times until a desired, usually smoothed, surface gradually emerges. The starting temperature or the temperature during annealing can be further raised to a higher level depending on the viscosity of the coating material. The engagement is recommended to be "soft," i.e., to gradually ramp up to the full pressure, for example, to use 10 to 15 seconds to ramp the contact pressure from no contact to the full pressure, say, 50 psi, and keeping the annealing roller rotating on the fuser roller during the pressure ramp up to achieve uniform results. The full pressure can be further changed during the annealing. For example, the product of thin fluorothermoplastic-PFA fluoropolymer resin semi-interpenetrating polymer network (SIPN) outer layer coated fuser rollers of 4" in diameter and annealed by a set of two chromed rollers of 2" in diameter and of the same length of the fuser roller requires an average 3 minutes of annealing time, during which period, both temperature and pressure can be further adjusted depending on the coating material. The example outer coating here has a thickness from 3 to 50 microns. The temperature, pressure and total time of annealing for the optimal coating surface result will vary with the coating's physical properties.

The invention is on the concept and practice of applying both heat and pressure from an externally heated device which will come in contact with the coating of the product to achieve a superior coating finish as well as strength to that as prepared, such as molded, baked, or heat-sintered. With this disclosure, those who are skilled in materials science, or polymer physics in particular, shall expect that known higher molecular weight PFA coating materials, for example, would require higher combined temperature and pressure to achieve the same surface finish than the lower molecular weight PFA materials. The annealing basically reshape and rearrange the coating at the micron level using heat and pressure simultaneously without degrading the coating material itself, and this not only achieves a certain surface finish of the coating, but also aligns polymeric chains in the annealing direction, and for the fuser roller example, it strengthens the coating's resistance to wear and cracking and delamination from its supporting layer during printing. In a sense, the above-melting point annealing with a short time of pressurized contact, as in the case of roller-type annealing device "re-melt" and "tightly glue" the coating to the underneath supporting layer with such an outcome that both coating in-track intrinsic strength, i.e., toughness and bonding to the supporting layer are greatly enhanced. The annealing process is further believed to effectively enhance interpenetration of the first and second compatible fluorothermoplastics of the formed semi-interpenetrating polymer network, eliminating the need for a first sintering step to flow together fluorocarbon resin particles. It is accordingly a feature of the present invention that a fuser member formed with a toner release layer that includes a SIPN of first and second fluorothermoplastics enables an annealed outer layer which has good performance without requiring higher temperature sintering of fluorocarbon resins.

The end of annealing takes place by disengaging the annealing rollers from contacting the surface of the product, i.e., the fuser roller. The ending of annealing can take place while the heater roller is still at high temperature and gradually one lowers the contact pressure to avoid sudden surface finish change for example on the fuser roller. Another way to end the annealing is by extended cooling with continued pressurized contact between the annealing roller and the coating of the fuser roller, as example, by gradually dropping temperature. As the temperature drops below the melting point of the material, for example 5° C. below, the rotating speed can also be increased with the pressure at the contact gradually reduced. Such an extended ending procedure with annealing at a lower than the melting point of the coating material can lead to a higher gloss finish on the coating surface than a more abrupt ending of the pressurized contact at a temperature higher than the melting point.

While known non-adhesive coatings for fuser members comprising fluoropolymer resin, though excellent non-stick materials, provide little compliance and conformability, use of an SIPN coating in accordance with the present invention enable more compliant and conformable fuser members to increase the contact area (nip) between the toner-bearing receiver and the fuser member and provide localized conformability to ensure desired toner fusing quality on all papers. More particularly, this invention provides an improved multi-layer coating for fuser members and a method of making the multi-layer coated fuser members for oil-free color digital printing application.

A preferred fuser member may further have a fluoropolymer (fluoroelastomer or fluorocarbon thermoplastic copolymer (FLC) or a mixture thereof) as a tie layer to provide good adhesion between the non-stick fluoropolymer SIPN resin top coat layer and a compliant silicone substrate layer. In addition, the tie layer may be incorporated with fluoropolymer resin fillers (PFA, FEP, PTFE, etc.) to increase the adhesion between the fluoropolymer SIPN resin outer layer and the tie layer. This also strengthens the adhesion to adjacent silicone layer and prevents the degradation of the silicone base cushion layer under external heated conditions.

In accordance with a particular embodiment, a fuser member prepared in accordance with this invention may comprise, in order, a core member comprising a cylindrical rigid outer surface;

a resilient layer disposed on the cylindrical outer surface comprising an elastomer;

a tie layer disposed on said resilient layer, said tie layer selected from the group consisting of fluoropolymers, fluoroelastomers, fluorocarbon thermoplastic copolymers and mixtures thereof;

a primer layer, disposed on said tie layer, comprising perfluoroalkoxy resin and trifluoroethylene-perfluoroethyl vinyl ether-perfluoroethylene vinyl phosphate or a mixture of perfluoroalkoxy resin and trifluoroethylene-perfluoroethylvinyl ether; and an outer layer comprising a semi-interpenetrating polymer network (SIPN) of compatible first and second fluorothermoplastics where the first fluorothermoplastics is crosslinked polymer and the second fluorothermoplastics is a liner polymer.

FIG. 1 shows a cross-sectional view of a fuser member 110, according to an embodiment of the invention, of which the applications include fuser rollers, pressure rollers, and oiled donor rollers, etc. The generally concentric central core or support 116 for supporting the plurality of the layers is usually metallic, such as stainless steel, steel, aluminum, etc. The primary requisite for the central core 116 materials are that it provides the necessary stiffness, being able to support the force placed upon it and to withstand a much higher temperature than the surface of the roller where there is an internal heating source. Deposited above the support 116 is a resilient layer, also termed the base cushion 113, which is characterized in the art as a "cushion" layer, with a function to accommodate the displacement for the fusing nip. Deposited above the base cushion layer 113 is a tie layer 114, which can be made of Viton, fluoroelastomer, or other fluoropolymer, such as fluorocarbon thermoplastic copolymer and mixtures thereof. Subsequently deposited above the tie layer 114 is a primer layer 111. The outermost layer 112, is a toner release layer, which comprises the semi-interpenetrating polymer network formed of compatible first and second fluorothermolastics as described above.

Figure 2:
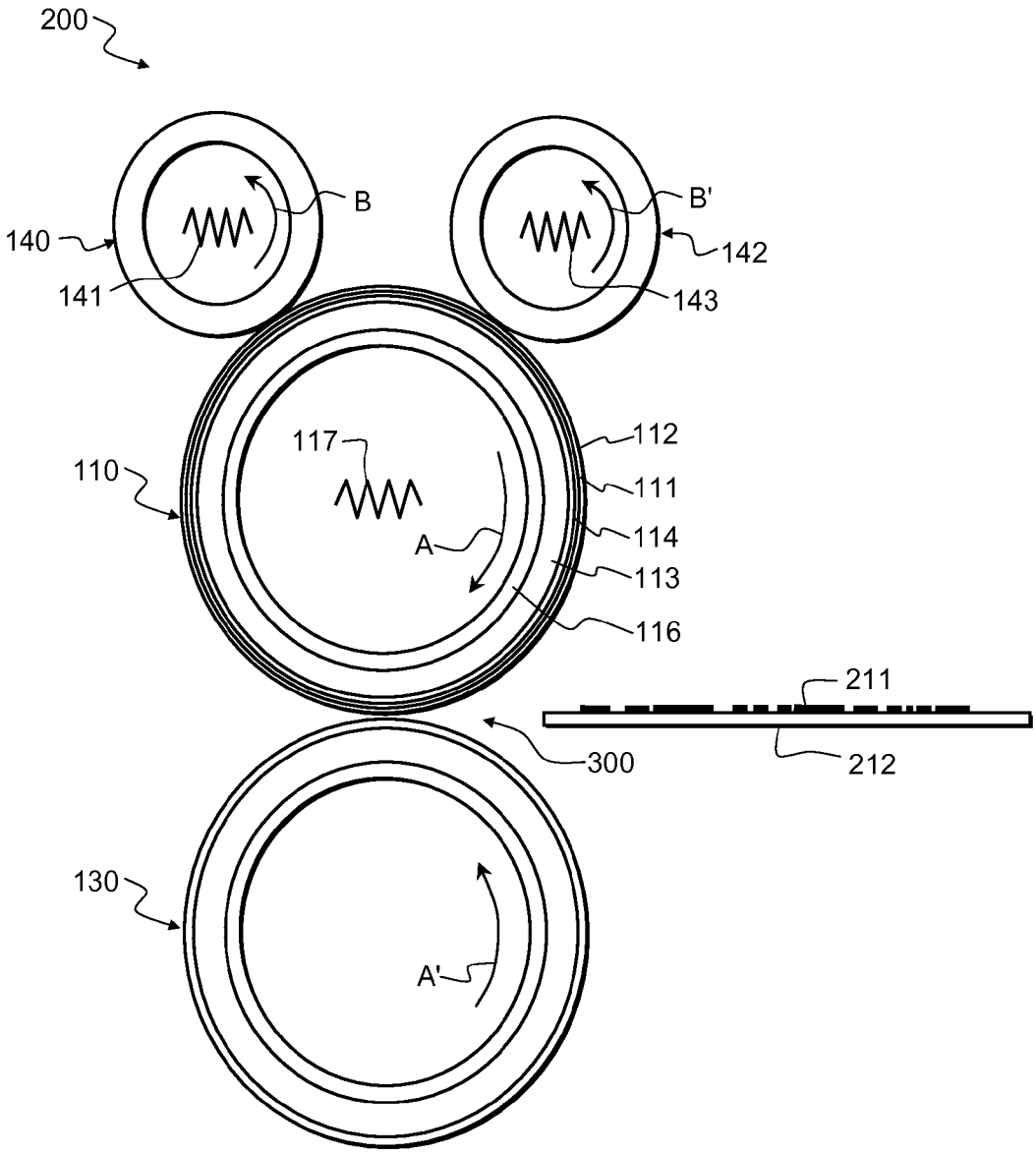
FIG. 2 is a schematic cross-sectional view of a fusing apparatus obtainable in accordance with an embodiment of the present invention.

Referring now to the accompanying drawings, FIG. 2 shows a preferred embodiment of a fuser station, inclusive of the inventive fuser roller structure, as designated by the numeral 200. The rotating fuser roller 110 moving in the direction indicated by arrow A includes a plurality of layers disposed about the axis of rotation. The plurality of the layers including a cylindrical core member 116 of high stiffness material, such as aluminum or steel, a relatively thick compliant base-cushion layer (BCL) 113, formed or molded on the core with perfect bondage at the interface, a seamless and relatively thin Viton layer 114, coated on top of the BCL 113, a seamless and relatively thin primer layer 111 coated on the Viton layer 114, with perfect bondage at the interface and a seamless and relatively thin topcoat 112 of relatively stiffer material than the elastomeric materials, coated on top of the primer layer 111, with perfect bondage at the interface. The topcoat 112 in FIGS. 1 and 2 is a thermally resistant layer comprising compatible first and second fluorothermoplastics forming a semi-interpenetrating polymer network (SIPN) as explained above, and is used for release of a toner image-receiving substrate 212 from the fusing member 110.

The surface of the fuser roller 110 can be externally heated by heater rollers, 140 and 142, which are of incandescent or ohm-rated heating filament 141 and 143, or internally heated by the incandescent or ohm-rated heating filament 117, or heated by the combination of both external heater rollers, 140 and 142, and internally heating incandescent or ohm-rated filament 117. A counteracting pressure roller 130 rotating in the direction A', countering the fuser roller rotating direction A forms a fusing nip 300 with the fuser roller 110 made of a plurality of compliant layers. An image-receiving substrate 212, generally paper, carrying unfused toner 211, i.e., fine thermoplastic powder of pigments, facing the fuser roller 110 is shown approaching the fusing nip 300. The substrate is fed by employing well know mechanical transports (not shown) such as a set of rollers or a moving web for example. The fusing station is preferable driven by one roller, for instance the fusing roller, 110, with pressure roller 130 and optional heater rollers, 140 and 142, being driven rollers.

The fuser member can be a pressure or fuser plate, pressure or fuser roller, a fuser belt or any other member on which a release coating is desirable. The support for the fuser member can be a metal element with or without additional layers adhered to the metal element. The metal element can take the shape of a cylindrical core, plate or belt. The metal element can be made of, for example, aluminum, stainless steel or nickel. The surface of the metal element can be rough, but it is not necessary for the surface of the metal element to be rough to achieve good adhesion between the metal element and the layer attached to the metal element. The additional support layers adhered to the metal element are layers of materials useful for fuser members, such as, silicone rubbers, fluoroelastomers and primers.

Inventive fuser member rollers are preferably cylindrically symmetrical, i.e., a cross-section of the roller taken at aright angle to the roller axis anywhere along the length of the roller has radial symmetry around the roller axis. The length of the roller thereof determines the range of the printing width of the substrate.

In one preferred embodiment of the invention, the support is a metal element coated with an adhesion promoter layer. The adhesion promoter layer can be any commercially available material known to promote the adhesion between silicone rubber and metal, such as silane coupling agents, which can be either epoxy-functionalized or amine-functionalized, epoxy resins, benzoguanamineformaldehyde resin crosslinker, epoxy cresol novolac, dianilinosulfone crosslinker, polyphenylene sulfide polyether sulfone, polyamide, polyimide and polyamide-imide. Preferred adhesion promoters are epoxy-functionalized silane coupling agents. The most preferable adhesion promoter is a dispersion of Thixon™ 300, Thixon™ 311 and triphenylamine in methyl ethyl ketone. The Thixon™ materials are supplied by Morton Chemical Co.

In another preferred embodiment of the invention, the support is a metal element with one or more resilient layers formed on said core member comprising an elastomer base cushion layer. The base cushion layer or layers can be of known materials for fuser member layers such as, one or more layers of silicone rubbers, fluorosilicone rubbers, or any of the same materials that can be used to form elastomer layers. Preferred silicone rubber layers are polymethyl siloxanes, such as EC-4952 (condensation cured silicone rubber), S5100 (addition cured silicone rubber), sold by Emerson Cummings or other addition cured silicone rubber Silastic™ J or E sold by Dow Corning or X-34-1284, X-34-2045 sold by ShinEtsu Company. Preferred fluorosilicone rubbers include polymethyltrifluoropropylsiloxanes, such as Sylon™ Fluorosilicone FX11293 and FX11299 sold by 3M.

In cases where it is intended that the fuser member be heated by an internal heater, it is desirable that the outer layer have a relatively high thermal conductivity, so that the heat can be efficiently and quickly transmitted toward the outer surface of the fuser member that will contact the toner to be fused. Depending upon relative thickness, it is generally also very desirable for the base cushion layer and any other intervening layers to have a relatively high thermal conductivity.

The thickness and composition of the base cushion and release layers can be chosen so that the base cushion layer provides the desired resilience to the fuser member and the release layer can flex to conform to that resilience. Usually, the release layer is thinner than the base cushion layer. For example, cushion layer thicknesses in the range from about 1.0 mm to about 10.0 mm have been found to be appropriate for various applications. In some embodiments of the present invention the base cushion layer is about 5.0 mm thick and the outer layer is from about 5 μm to about 50 μm thick.

According to the current invention, suitable materials for the base cushion layer include any of a wide variety of materials previously used for base cushion layers, such as the condensation cured polydimethylsiloxane marketed as EC4952 by Emerson Cuming. Another example of an additional cured silicon rubber base cushion layer is marked as S5100 by Emerson Cuming. An example of an additional cured silicone rubber is X-34-1284, from ShinEtsu Company, which is applied over a silane primer X-33-173 or X-33-156-20, also obtainable from ShinEtsu Company.

In a particular embodiment, the base cushion is resistant to cyclic stress induced deformation and hardening. Examples of suitable materials to reduce cyclic stress induced deformation and hardening are filled condensation-crosslinked PDMS elastomers, disclosed in U.S. Pat. No. 5,269,740 (copper oxide filler), U.S. Pat. No. 5,292,606 (zinc oxide filler), U.S. Pat. No. 5,292,562 (chromium oxide filler), U.S. Pat. No. 5,480,724 (tin oxide filler) and U.S. Pat. No. 5,336,539 (nickel oxide filler). These materials all show reasonable thermal conductivities and much less change in hardness and creep than EC4952 or the PDMS elastomer with aluminum oxide filler. Additional suitable base cushions are disclosed in U.S. Pat. No. 5,466,533, entitled "Zinc Oxide Filled Diphenylsiloxane-Dimethylsiloxane Fuser Roll for Fixing Toner to a Substrate," U.S. Pat. No. 5,474,852, entitled "Tin Oxide Filled Diphenylsiloxane-Dimethylsiloxane Fuser Roll for Fixing Toner to a Substrate," and U.S. Pat. No. 5,464,703, entitled "Tin Oxide Filled Dimethylsiloxane-Fluoroalkylsiloxane Fuser Roll for Fixing Toner to a Substrate." The disclosures of the patents and patent applications mentioned in this paragraph are hereby incorporated herein by reference.

The support of the fuser member, which is usually cylindrical in shape, can be formed from any rigid metal or plastic substance. Because of their generally high thermal conductivity, metals are preferred when the fuser member is to be internally heated. Suitable support materials include, e.g., aluminum, steel, various alloys, and polymeric materials such as thermoset resins, with or without fiber reinforcement. The support has been conversion coated and primed with metal alkoxide primer in accordance with U.S. Pat. No. 5,474,821, the disclosure of which is incorporated herein by reference.

The fuser member is mainly described herein in terms of embodiments in which the fuser member is a fuser roll having a support, an adhesion promoter layer, a base cushion layer overlying the support, a tie layer, a primer layer and an outer SIPN layer superimposed on the primer layer. The invention is not, however, limited to a roll, or to having each of the noted layers. Nor is the invention limited to a fusing member having a support bearing two layers, the base cushion layer and the outer layer. The fuser member of the invention can have a variety of outer configurations and layer arrangements known to those skilled in the art. For example, the base cushion layer may be eliminated, or the outer layer described herein can be overlaid by one or more additional layers.

The base cushion layer may be adhered to the metal element via a base cushion primer layer. The base cushion primer layer can include a primer composition that improves adhesion between the metal element and the material used for the base cushion layer. If the base cushion layer is a fluoroelastomer material, the adhesion promoters described above can be used as the base cushion primer layer. Other primers for the application of fluorosilicone rubbers and silicone rubbers to the metal element are known in the art. Such primer materials include silane coupling agents such as X-33-176 or X-33-156-10 sold by ShinEtsu company, which can be either epoxy-functionalized or amine-functionalized, epoxy resins, benzoguanamineformaldehyde resin crosslinker, epoxy cresol novolac, dianilinosulfone crosslinker, polyphenylene sulfide polyether sulfone, polyamide, polyimide and polyamide-imide.

The inclusion of a base cushion layer on the metal element of the support increases the compliancy of the fuser member. By varying the compliancy, optimum fuser members and fuser systems can be produced. The variations in the compliancy provided by optional base cushion layers are in addition to the variations provided by just changing the thickness or materials used to make the fluoroelastomer layer and/or fluoropolymer resin layer. The presently preferred embodiment in a fuser roller system is to have a very compliant fuser roller and a non-compliant or less compliant pressure roller. In a fuser belt system it is preferred to have a compliant pressure roller and a non-compliant or less compliant belt. Although the above are the presently preferred embodiments, fuser systems and members including plates, belts and rollers can be made in various configurations and embodiments wherein at least one fuser member is made according to this invention.

It may be desirable to provide a good insulation layer between the non-stick layer 112 and any soft, heat unstable silicone rubber base layer which may be employed as a based cushion layer 113. Most importantly, the additional tie layer between the topcoat layer 112 and the cushion layer 113 must provide good bonding between these two layers under harsh stress and elevated temperature conditions to prevent delamination and wrinkling of the non-stick top coat layer. Accordingly, fuser member in accordance with present invention may comprise a fluoropolymer (fluoroelastomer or fluorocarbon thermoplastic copolymer (FLC) or a mixture thereof) as a tie layer 114 to provide good adhesion between the non-stick top coat layer 112 and a compliant silicone base cushion layer 113. In preferred embodiments of the invention, the bonds between the fluoropolymer resin layers, primer layers and fluoroelastomer layers are very strong, making it very difficult to peel the layers apart.

The base cushion and/or tie fluoroelastomer layer can include copolymers of vinylidene fluoride and hexafluoropropylene, copolymers of tetrafluoroethylene and propylene, terpolymers of vinylidene fluoride, hexafluoropropylene and tetrafluoroethylene, terpolymers of vinylidene fluoride, tetrafluoroethylene and perfluoromethylvinylethyl, and terpolymers of vinylidene fluoride, tetrafluoroethylene, and perfluoromethylvinylether. Specific examples of fluoroelastomers which are useful in this invention are commercially available from E. I. DuPont de Nemours and Company under the trade names Kalrez™, and Viton™ A, B, G, GF and GLT, and from 3M Corp. under the trade names Fluorel™ FC 2174, 2176 and FX 2530 and FLS 2640 and FE 5832 and Aflas™. Additional vinylidene fluoride based polymers useful in the fluoroelastomer layer are disclosed in U.S. Pat. No. 5,035,950, the disclosure of which is incorporated herein by reference. Mixtures of the foregoing fluoroelastomers may also be suitable. Although it is not critical in the practice of this invention, the number-average molecular weight range of the fluoroelastomers may vary from a low of about 10,000 to a high of about 200,000. In the preferred embodiments, vinylidene fluoride-based fluoroelastomers have a number-average molecular weight range of about 50,000 to about 100,000.

A preferable material for the fluoroelastomer layer is a compounded mixture of a fluoroelastomer polymer, a curing material, and optional fillers. The curing material can include curing agents, crosslinking agents, curing accelerators and fillers or mixtures of the above. Suitable curing agents for use in the process of the invention include the nucleophilic addition curing agents as disclosed, for example, in the patent to Seanor, U.S. Pat. No. 4,272,179, incorporated herein by reference. Exemplary of a nucleophilic addition cure system is one comprising a bisphenol crosslinking agent and an organophosphonium salt as accelerator. Suitable bisphenols include 2,2-bis(4-hydroxyphenyl)hexafluoropropane, 4,4-isopropylidenediphenol and the like. Although other conventional cure or crosslinking systems may be used to cure the fluoroelastomers useful in the present invention, for example, free radical initiators, such as an organic peroxide, for example, dicumylperoxide and dichlorobenzoyl peroxide, or 2,5-dimethyl-2,5-di-t-butylperoxyhexane with triallyl cyanurate, the nucleophilic addition system is preferred. Suitable curing accelerators for the bisphenol curing method include organophosphonium salts, e.g., halides such as benzyl triphenylphosphonium chloride, as disclosed in U.S. Pat. No. 4,272,179 cited above.

The fluoroelastomer also can include fluoropolymer resin filler. Fluoropolymer resin filler are added to polymeric compositions from 10 to 100 pph based on the weight of the fluoroelastomer layer to provide added adhesion strength and mechanical strength to a surface layer. In the fluoroelastomer layer of the fuser member of this invention, inclusion of the fluoropolymer resin filler is preferred. Omission of the fluoropolymer resin filler will reduce the adhesive strength of the fluoroelastomer layer to the top layer. Suitable fluoropolymer resin fillers include a fluoropolymer material, such as a semicrystalline fluoropolymer or a semicrystalline fluoropolymer composite. Such materials include polytetrafluoroethylene (PTFE), polyperfluoroalkoxy-tetrafluoroethylene (PFA), polyfluorinated ethylene-propylene (PEP), poly(ethylenetetrafluoroethylene), polyvinylfluoride, polyvinylidene fluoride, poly(ethylene-chloro-trifluoroethylene), polychlorotrifluoroethylene and mixtures of fluoropolymer resins.

The fluoroelastomer can optionally include inert filler. Inert fillers are frequently added to polymeric compositions to provide added strength and abrasion resistance to a surface layer. Omission of the inert filler does not reduce the adhesive strength of the fluoroelastomer layer. Suitable inert fillers that are optionally used include mineral oxides, such as alumina, silica, titania, and carbon of various grades.

Nucleophilic addition-cure systems used in conjunction with fluoroelastomers can generate hydrogen fluoride and thus acid acceptors may be added as fillers. Suitable acid acceptors include Lewis bases such as lead oxide, magnesium oxide, such as Megalite™ D and Y supplied by Merck & Co., calcium hydroxide, such as C-97, supplied by Fisher Scientific Co., zinc oxide, copper oxide, tin oxide, iron oxide and aluminum oxide which can be used alone or as mixtures with the aforementioned inert fillers in various proportions. The most preferable fluoroelastomer layer material comprises a compounded mixture of 100 parts Viton™ A, from 2 to 9 parts 2,2-bis(4-hydroxyphenyl)hexafluoropropane, commercially available as Cure™ 20, from 2 to 10 parts benzyl triphenylphosphonium chloride, commercially available as Cure 30™, from 5 to 30 parts lead oxide and from 0 to 30 parts Thermax™ (carbon black), mechanically compounded at room temperature on a two roll mill until it forms a uniform mixture. Cure™ 20 and Cure™ 30 are products of Morton Chemical Co. Thermax™ is a product of R. T. Vanderbilt Co., Inc. This compounded mixture can either be compression molded onto the support, or dispersed in solvent for dip-, ring- or spray-coating onto the support. If ring-coating is used to apply this compounded mixture to the support, then it is preferable to add a small amount of aminosiloxane polymer to the formulation described above, while compounding the fluoroelastomer material. For additional information on this fluoroelastomer composite material, see U.S. Pat. No. 4,853,737, which is incorporated herein by reference.

The fluoroelastomer layer can also be a fully interpenetrating network of cured fluoroelastomer and a silicone polymer. An interpenetrating network coating composition can be obtained by mechanically compounding fluoroelastomer polymer, functionalized siloxane, fluorocarbon curing materials and optional acid acceptors or other fillers to form a uniform mixture suitable for compression molding or solvent coating after dispersing the composite in a solvent. The fluoroelastomer polymers, curing materials, curing agents, curing accelerators, acid acceptors and other fillers can be selected from those previously described above. The functionalized siloxane is preferably a polyfunctional poly($C_{1-6}$ alkyl)phenyl siloxane or polyfunctional poly($C_{1-6}$ alkyl)siloxane. Preferred siloxanes are heat-curable, however peroxide-curable siloxanes can also be used with conventional initiators. Heat curable siloxanes include the hydroxy-functionalized organopolysiloxanes belonging to the classes of silicones known as "hard" and "soft" silicones. Preferred hard and soft silicones are silanol-terminated polyfunctional organopolysiloxanes.

Exemplary hard and soft silicones are commercially available or can be prepared by conventional methods. Examples of commercially available silicones include DC6-2230 silicone and DC-806A silicone (sold by Dow Corning Corp.), which are hard silicone polymers, and SFR-100 silicone (sold by General Electric Co.) and EC-4952 silicone (sold by Emerson Cummings Co.), which are soft silicone polymers. DC6-2230 silicone is characterized as a silanol-terminated polymethyl-phenylsiloxane copolymer containing phenyl to methyl groups in a ratio of about 1 to 1, difunctional to trifunctional siloxane units in a ratio of about 0.1 to 1 and having a number-average molecular weight between 2,000 and 4,000. DC-806A silicone is characterized as a silanol-terminated polymethylphenylsiloxane copolymer containing phenyl to methyl groups in a ratio of about 1 to 1 and having difunctional to trifunctional siloxane units in a ratio of about 0.5 to 1. SFR-100 silicone is characterized as a silanol- or trimethylsilyl-terminated polymethylsiloxane and is a liquid blend comprising about 60 to 80 weight percent of a difunctional polydimethylsiloxane having a number-average molecular weight of about 90,000 and 20 to 40 weight percent of a polymethylsilyl silicate resin having monofunctional (i.e. $SiO_2$) repeating units in an average ratio of between about 0.8 and 1 to 1, and having a number-average molecular weight of about 2,500. EC-4952 silicone is characterized as a silanol-terminated polymethylsiloxane having about 85 mole percent of difunctional dimethylsiloxane repeating units, about 15 mole percent of trifunctional methylsiloxane repeating units and having a number-average molecular weight of about 21,000.

Preferred fluoroelastomer-silicone interpenetrating networks have ratios of silicone to fluoroelastomer polymer between about 0.1 and 1 to 1 by weight, preferably between about 0.2 and 0.7 to 1. The interpenetrating network is preferably obtained by mechanically compounding, for example, on a two-roll mill a mixture comprising from about 40 to 70 weight percent of a fluoroelastomer polymer, from 10 to 30 weight percent of a curable polyfunctional poly($C_{1-6}$ alkyl) phenylsiloxane or poly($C_{1-6}$ alkyl)siloxane polymer, from 1 to 10 weight percent of a curing agent, from 1 to 3 weight percent of a curing accelerator, from 5 to 30 weight percent of an acid acceptor type filler and from 0 to 30 weight percent of an inert filler.

When a fluoroelastomer-silicone interpenetrating network is the fluoroelastomer layer material, the support is coated by conventional techniques, usually by compression molding or solvent coating. The solvents used for solvent coating include polar solvents, for example, ketones, acetates and the like. Preferred solvents for the fluoroelastomer based interpenetrating networks are the ketones, especially methyl ethyl ketone and methyl isobutyl ketone. The dispersions of the interpenetrating networks in the coating solvent are at concentrations usually between about 10 to 50 weight percent solids, preferably between about 20 to 30 weight percent solids. The dispersions are coated on the support to give a 10 to 100 micrometer thick sheet when cured.

Curing of the fluoroelastomer-silicone interpenetrating network is carried out according to the well known conditions for curing fluoroelastomer polymers ranging, for example, from about 12 to 48 hours at temperatures of between 50° C. to 250° C. Preferably, the coated composition is dried until solvent free at room temperature, then gradually heated to about 230° C. over 24 hours, then maintained at that temperature for 24 hours. Additional information on fluoroelastomer-silicone polymer interpenetrating networks can be found in U.S. Pat. No. 5,582,917, the disclosure of which is incorporated herein by reference.

The primer layer between the SIPN fluorothermoplastic polymer outer layer and the tie layer may consist of a mixture of a fluoropolymer resin and trifluoroethylene-perfluoroethylvinyl ether-perfluoroethylene vinyl phosphate, commercially available from DuPont under the trade name Teflon™ 855P322-33 or a mixture of perfluoroalkoxy resin and trifluoroethylene-perfluoroethylvinyl ether, commercially available from DuPont under the trade name Teflon™ 855P322-31. Such primer layer provides an adhesive layer between the tie layer (being made of fluoropolymers, fluoroelastomers, fluorocarbon thermoplastic copolymers and mixtures thereof) and the SIPN outer layer. A variety of other primers such as polyamide-imide, polyimide or epoxy resin may also be used for this purpose, but it has been found that superior results are achieved with a mixture of a fluoropolymer resin and trifluoroethylene-perfluoroethylvinyl ether-perfluoroethylene vinyl phosphate or a mixture of perfluoroalkoxy resin and trifluoroethylene-perfluoroethylvinyl ether. The primer may be heated before it is applied to the application of the fluoropolymer resin layer.

The fluoropolymer resins in the primer layer composition can be any of the previously disclosed fluoropolymer resins, such as, polytetrafluoroethylene, polyperfluoroalkoxy-tetrafluoroethylene, polyfluorinated ethylene-propylene. It is not required that the fluoropolymer resin in the primer mixture be the same fluoropolymer resin or blend of fluoropolymer resins in the fluoropolymer resin layer. Preferred primers consist of perfluoroalkoxy resin and trifluoroethylene-perfluoroethylvinyl ether-perfluoroethylene vinyl phosphate or trifluoroethylene-perfluoroethylvinyl ether in a ratio of from 1 to 10 to 10 to 1 by weight of perfluoroalkoxy resin to trifluoroethylene-perfluoroethylvinyl ether or trifluoroethylene-perfluoroethylvinyl ether-perfluoroethylene vinyl phosphate.

The thicknesses of the layers of the fuser members of this invention can vary depending on the desired compliancy or non-compliancy of a fuser member. The preferred thickness of the layers for a fuser member having a base cushion layer as part of the support are as follows: the base cushion primer layer may be between 0.1 and 1 micron; the base cushion layer may be between 1 and 10 mm, the fluoroelastomer layer may be between 10 and 500 micron; and the fluoropolymer resin layer may be between 5 and 50 microns. The preferable thicknesses for the layers of a fuser member with base cushion layer (resilient layer) as part of the support are as follows: the adhesion promoter may be between 0.3 and 1 mils; the base cushion layer may be between 2 and 6 mm; the fluoroelastomer layer may be between 10 and 50 micron; and the SIPN fluorothermoplastics polymer resin layer may be between 5 and 30 micron.

The compositions of the above-described layers of the fuser member may optionally contain additives or fillers such as aluminum oxide, iron oxide, magnesium oxide, silicon dioxide, titanium dioxide, calcium hydroxide, lead oxide, zinc oxide, copper oxide and tin oxide to increase the thermal conductivity or the hardness of the layers. Pigments may be added to affect the color. Optional adhesive materials and dispersants may also be added.

The fuser members of this invention include a core member that includes a rigid outer surface. The coated fuser member of this invention having a support can be made by the following steps: An adhesion promoter layer comprising silane or epoxy silane coupling is disposed on cylindrical outer surface of the core member. A resilient layer comprising an elastomer is disposed on the adhesion promoter layer. A tie layer is disposed on the resilient layer, the tie layer being made of fluoropolymers, fluoroelastomers, fluorocarbon thermoplastic copolymers and mixtures thereof. The fluoroelastomer layer is applied to the adhesion promoter layer usually by compression-molding, extrusion-molding, or blade-, spray-, ring- or dip-coating the fluoroelastomer layer onto the support. The fluoroelastomer layer is then cured typically in an oven at temperatures between about 390° F. and 500° F. A primer layer is disposed on the tie layer, comprising perfluoroalkoxy resin and trifluoroethylene-perfluoroethyl vinyl ether-perfluoroethylene vinyl phosphate or a mixture of perfluoroalkoxy resin and trifluoroethylene-perfluoroethylvinyl ether. It is necessary to dry the primer layer before applying the fluoropolymer resin layer. The primer layer is then cured typically in an oven at temperatures between about 200° F. and 300° F. The fluoropolymer resin layer comprising a semi-interpenetrating polymer network (SIPN) of compatible first and second fluorothermoplastics where the first fluorothermoplastics THV polymer is crosslinked polymer and the second fluorothermoplastics PFA is a liner polymer can be applied to the primer layer by the same methods for applying the fluoroelastomer layer. Preferably, the fluoropolymer resin layer is applied by ring-coating an aqueous emulsion of the first and second compatible fluorothermoplastics over the primer layer. Then, the fuser member is placed in an oven typically at temperatures between about 150° C. to about 200° C. for 2 to 4 hours to cure the first fluorothermoplastic polymer and form an SIPN layer. (The specified temperature ranges can vary depending upon the material to be cured and the curing time.) Annealing the surface of the outer layer by contact of the surface of the fuser member to a heating roller as described above to provide a fuser member having smooth surface finish.

One embodiment of the invention has a condensation cured silicone rubber layer as part of the resilient layer. For example, to make a coated fuser member with a support including a metal element, silicone rubber primer layer, and a condensation cure silicone rubber layer, and then the fluoroelastomer layer, a primer layer and fluoropolymer resin layer, the method is as follows: Firstly, the metal element is cleaned and dried as described earlier. Secondly, the metal element is coated with a layer of a known silicone rubber primer, selected from those described earlier. A preferred primer for a condensation cure silicone rubber base cushion layer is GE 4044 supplied by General Electric. Thirdly, the silicone rubber layer is applied by an appropriate method, such as, blade-coating, ring-coating, injection-molding or compression-molding the silicone rubber layer onto the silicone rubber primer layer. A preferred condensation cure polydimethyl siloxane is EC-4952 produced by Emerson Cummings. Fourthly, the silicone rubber layer is cured, usually by heating it to temperatures typically between 410° F. and 450° F. in an oven. Fifthly, the silicone rubber layer undergoes corona discharge treatment usually at about 750 watts for 90 to 180 seconds. From here the process of applying and curing the fluoroelastomer layer, a primer layer, and fluoropolymer resin layer described above is followed.

In yet other embodiments of the invention with an addition cured silicone rubber layer as part of the resilient layer, the process is modified as follows. When the base cushion layer is an addition cure silicone rubber, the preferred silicone primer X-33-176 supplied by ShinEtsu Co. is applied to the metal element. Then, the preferred addition cure silicone rubber X-34-1284 supplied by ShinEtsu Co is applied, for example, by injection-molding. The silicone rubber layer is then cured. If the base cushion layer is a fluorosilicone elastomer, the metal element is primed with a known silicone primer, then the fluorosilicone elastomer layer is applied, usually by compression-molding and cured. If a fluoroelastomer-silicone interpenetrating network or other additional fluoroelastomer material is used as the base cushion layer or layers, an adhesion promoter appropriate for a fluoroelastomer layer is applied to the metal element, the fluoroelastomer base cushion layer is applied to the base cushion primer layer and cured. If the base cushion layer is a fluoroelastomer material it is not necessary to cure, prime or to corona discharge treat the base cushion fluoroelastomer layer before application of the fluoroelastomer layer to it.

There are optional sandblasting, grinding and polishing steps. As stated earlier, it is not necessary to sandblast the metal element because it is not required for good adhesion between the metal element and the adjacent layer. However, the fluoroelastomer layer and additional base cushion layer or layers, if any, may be ground during the process of making the fuser members. These layers may be mechanically ground to provide a smooth coating of uniform thickness that sometimes may not be the result when these layers are applied to the support, especially by the processes of compression-molding or blade-coating.

Any kind of known heating method can be used to cure the layers onto the fuser member, such as convection heating, forced air heating, infrared heating, and dielectric heating.

The fuser members produced in accordance with the present invention are useful in electrophotographic copying machines to fuse heat-softenable toner to a substrate. This can be accomplished by contacting a receiver, such as a sheet of paper, to which toner particles are electrostatically attracted in an imagewise fashion with such a fuser member. Such contact is maintained at a temperature and pressure sufficient to fuse the toner to the receiver. Because these members are so durable they can be cleaned using a blade, pad, roller or brush during use. Although it may not be necessary because of the excellent release properties of the fluoropolymer resin layer, release oils may be applied to the fuser member without any detriment to the fuser member. The fuser members produced in accordance with the present invention further may be advantageously refurbished employing an in-line method such as taught in U.S. Patent Application No. 2008/0280035 when employed in electrophotographic apparatus as described in U.S. Pat. No. 7,565,091 and U.S. Patent Application Publication No. 2009/0250830, the disclosures of which are incorporated herein by reference.

Although not explicitly disclosed in the preferred embodiments, it will be understood that an optional supplementary source of heat for fusing, either external or internal, may be provided, directly or indirectly, to any roller included in a fusing station of the invention.

The following examples illustrate the preparation of the fuser members of this invention.

Example 1-3

A coated roller including, in order, a support, a base cushion primer layer and a silicone rubber layer, a fluoroelastomer layer, and a conformable fluorothermoplastic-PFA fluoropolymer resin semi-interpenetrating polymer network (SIPN) layer was prepared.

A steel cylindrical core with a 3.5 inch outer diameter and 15.2 inch length that was blasted with glass beads and cleaned and dried with dichloromethane was uniformly spray-coated with an adhesion promoter ShinEtsu X-33-176 to a uniform thickness of from 0.1 to 0.2 mil. The adhesion promoter was air dried for 15 minutes and placed in a convection oven at 325° F. for 45 minutes. A silicone base cushion layer is then applied to the treated core. The preferred addition cure silicone rubber X-34-1284 supplied by ShinEtsu Co is applied, for example, by injection-molding. The silicone rubber then cured 24 hrs at room temperature, and post cured 3 hrs at 200° C. in a convection oven. The resulting thickness of the base cushion layer was 220 mil. The fluoroelastomer coating was prepared by compounding 100 parts of Fluorel™ 2640, 4 parts Cure™ 50, 3 parts magnesium oxide, 6 parts calcium hydroxide, 10 parts Thermax and 50 parts FEP are dissolved into a MEK solution to formed a 25 weight percent solid solution. A portion of the resulting solution was ring coated onto a core with the silicone base cushion layer as previously described, air dried 1 hour. The conditions for the post-cure were a 24 hour ramp to 232° C. and 24 hours at 232° C. The resulting fluoroelastomer layer had 25 micron in thickness. The primer layer Teflon 855N-702 available from DuPont Co., comprising perfluoroalkoxy resin and trifluoroethylene-perfluoroethylvinyl ether-perfluoroethylene vinyl phosphate, was ring coated onto a core with the fluoroelastomer layer as previously described, then air dried 1 hours. The conditions for the post-cure were a 1 hour ramp to 120° C. and 2 hours at 120° C. The resulting PFA primer Teflon™ 855N-702 layer had 2 to 5 micron in thickness.

Fluorocarbon thermoplastic random copolymer THV 340Z, polyfunctional amine comprises triethylenetetraamine (TETA), and DuPont Teflon™ EM-402CL consisting of polytetrafluoroethylene, polyperfluoroalkoxy-tetrafluoroethylene, polyfluorinated ethylene-propylene resin were mixed as indicated (amounts listed as parts per hundred) in Table 1 with varying amounts of triethylenetetraamine (TETA). The triethylenetetraamine (TETA) is sold by the Aldrich Co. Milwaukee, Wis. The formulations were all mixed on a two-roll mill then dissolved to form a 25 weight percent solids solution in aqueous water solution. Part of the resulting material was ring coated onto the cured fluoroelastomer layer, and air dried for 8 hours. Examples 1, 2 and 3 were cured at 175° C. for 4 hours to crosslink the THV 340Z fluorocarbon thermoplastic random copolymer. The resulting outer layer of semi-interpenetrating polymer network had a thickness of 1 mil.

The fuser member was then placed in an annealing device at 310° C. for approximately 2 to 3 minutes to anneal the THV 340Z-PFA Teflon™ fluorothermal plastics semi-interpenetrating polymer network. The fuser member is next engaged with a set of annealing hard rollers of 2" in diameter, preferably chromed, with the surface temperature of the heated rollers above the melting point, such as 310° C. The fuser member is set to roll against the heater rollers at 3 rpm, and the contact pressure is gradually increase from 0 to 50 psi over 30 seconds. As the full engagement starts, the fuser roller is allowed to roll through the nip between itself and the annealing roller for 3 minutes until a desired, usually smoothed, surface gradually emerges. The starting temperature or the temperature during annealing can be further raised to a higher level depending on the viscosity of the coating material. The roller will be gradually cooled down and the heater roller disengaged. The roller thus prepared had excellent surface gloss and adhesion between the layers.

The compositions for Examples 1-3 are listed in Table 1.

Comparative Example 1

A coated roller consisting of, in order, a support, a base cushion primer layer and a silicone rubber layer, and a PFA fluoropolymer resin outer layer was prepared.

Example 1 was repeated except a PFA fluoropolymer resin layer without a cross-linked fluorothermoplastic was used as a top coat layer, similarly as in U.S. Pat. No. 7,534,492. An outer layer of DuPont Teflon™ EM-402CL consisting of polyperfluoroalkoxy-tetrafluoroethylene was ring-coated on the fluoelastomer base cushion, and placed in a convection oven at 700° F. for approximately 10 minutes to sinter the PFA prior to being annealed.

Comparative Example 2

Comparative example 1 was repeated with another batch of EM-402 CL material.

TABLE 1

| Sample | THV-340Z | PFA EM-402CL | TETA |
|---|---|---|---|
| Example 1 | 100 | 100 | 3 |
| Example 2 | 100 | 100 | 4 |
| Example 3 | 100 | 100 | 8 |
| C-Example 1 | 0 | 100 | 0 |
| C-Example 2 | 0 | 100 | 0 |

Surface Gloss Value Measurements of Fuser Rollers

Fuser rollers prepared as described in Example 1, 2 and Example 3 were analyzed for G60 value by using the Gardner Micro-TRI-Gloss 20-60-85 Glossmeter. A gloss measurement with the Glossmeter is taken at 6 different locations on the fuser member, and the values are then averaged to obtain a nominal G60 gloss for the fuser member. Similar gloss measurements were also performed in Comparative Example 1 and Comparative Example 2. The results of the roughness measurements are listed in Table 2.

TABLE 2

| Sample | Low Temperature cure | Sintering at 368° C. | Gloss before Annealing | Gloss after Annealing |
|---|---|---|---|---|
| Example 1 | 175° C. | No | 9.5 | 14 |
| Example 2 | 175° C. | No | 10 | 14 |
| Example 3 | 175° C. | No | 13.7 | 25 |
| C-Example 1 | No | 368° C. | 14.2 | 45 |
| C-Example 2 | No | 368° C. | 16.4 | 50 |

Table 2 shows 3 sets of rollers Example 1 to 3, all the rollers only with low temperature cured (175° C.) without high temperature sintering (368° C.) before the annealing process compared to the other two sets of rollers, each set made with PFA EM-402CL topcoat with conventional PFA coating. Table 2 shows that the current invention after annealing process greatly improved the gloss stability of the fuser member surface for all topcoat formulations. The mechanical strength of base cushion material accordingly had dramatic improvement by the annealing without the need of high temperature sintering.

The invention has been described in detail with particular reference to certain preferred embodiments thereof, but it will be understood that variations and modifications can be effected within the spirit and scope of the invention.

The invention claimed is:

1. A method of making a fuser member having an annealed outer surface comprising:

providing an outermost layer comprising compatible first and second fluorothermoplastics over an outer substrate surface, wherein the first fluorothermoplastic is a crosslinkable polymer and the second fluorothermoplastic is a linear polymer;

curing the outermost layer to crosslink the first fluorothermoplastic whereby the resulting crosslinked first fluorothermoplastic and the linear polymer second fluorothermoplastic form a semi-interpenetrating polymer network (SIPN); and annealing an outer surface of the outermost layer by contacting the fuser member with applied pressure against a heated surface, without first sintering the second fluorothermoplastic linear polymer through application of heat.

2. The method of claim 1, wherein the heated surface is heated to a temperature of from 80° C. below the melting point to 20° C. above the melting point of the second fluorothermoplastic, and is contacted at a pressure of greater than 5 psi.

3. The method of claim 1 wherein the first fluorothermoplastic comprises a fluorocarbon thermoplastic random copolymer having the subunits of:

$$—(CH_2CF_2)x-, —(CF_2CF(CF_3))y-, \text{ and } —(CF_2CF_2)z-,$$

wherein x is from 1 to 40 or 60 to 80 mole percent, z is greater than 40 to no more than 89 mole percent, and y is such that x+y+z equals 100 mole percent.

4. The method of claim 3 wherein the second fluorothermoplastic comprises polyperfluoroalkoxy-tetrafluoroethylene (PFA).

5. The method of claim 4 wherein the fluorocarbon thermoplastic random copolymer is crosslinked with a polyfunctional amine.

6. The method of claim 5 wherein the polyfunctional amine comprises triethylenetetraamine (TETA).

7. The method of claim 1 wherein the substrate comprises a rigid cylinder or a rigid plate.

8. The method of claim 1 wherein the substrate comprises a flexible endless belt.

9. The method of claim 1 further comprising providing a resilient layer comprising an elastomer disposed between the outer substrate surface and the outermost layer.

10. The method of claim 9, wherein said resilient layer comprises a thickness of from 1 to 10 mm.

11. The method of claim 10, wherein said outermost layer comprises a thickness of from 5 to 50 microns.

12. The method of claim 1 wherein the annealing step is conducted at for least 1 minute.

13. The method of claim 1 wherein the annealing step comprises:

providing a heating roller;

contacting the outermost layer of said fuser member with a surface of said heating roller.

14. The method of claim 1 wherein annealing step is performed within an electrophotographic machine.

15. The method of claim 1, wherein said outermost layer comprises a thickness of from 5 to 50 microns.

16. The method of claim 1, wherein the heated surface is heated to a temperature of from 225° C. to 325° C., and is contacted at a pressure of greater than 5 psi.

* * * * *